US007703175B2

(12) United States Patent
Tuller

(10) Patent No.: US 7,703,175 B2
(45) Date of Patent: Apr. 27, 2010

(54) CURL SPRING COVER

(75) Inventor: Jeffrey Tuller, Rochester, NY (US)

(73) Assignee: Caldwell Manufacturing Company, Rochester, NY (US)

( * ) Notice: Subject to any disclaimer, the term of this patent is extended or adjusted under 35 U.S.C. 154(b) by 185 days.

(21) Appl. No.: 11/834,073

(22) Filed: Aug. 6, 2007

(65) Prior Publication Data

US 2008/0034537 A1 Feb. 14, 2008

Related U.S. Application Data

(60) Provisional application No. 60/821,731, filed on Aug. 8, 2006.

(51) Int. Cl.
*E05D 13/00* (2006.01)

(52) U.S. Cl. ..... 16/197; 49/448

(58) Field of Classification Search ..... 16/197, 16/199, 205, 206, 208, 211, 214; 49/445, 49/447, 448, 181
See application file for complete search history.

(56) References Cited

U.S. PATENT DOCUMENTS

| | | | | |
|---|---|---|---|---|
| 4,800,680 | A * | 1/1989 | Westfall et al. | 49/429 |
| 5,365,638 | A | 11/1994 | Braid et al. | |
| 5,586,362 | A * | 12/1996 | Baker | 16/193 |
| 6,178,696 | B1 * | 1/2001 | Liang | 49/185 |
| 6,412,144 | B1 * | 7/2002 | Braid et al. | 16/197 |
| 6,584,644 | B2 | 7/2003 | Braid et al. | |
| 6,606,761 | B2 * | 8/2003 | Braid et al. | 16/197 |
| 6,820,368 | B2 * | 11/2004 | Uken et al. | 49/181 |
| 6,848,148 | B2 | 2/2005 | Braid et al. | |
| 7,076,835 | B2 | 7/2006 | Harold et al. | |
| 2004/0163209 | A1 * | 8/2004 | Pettit | 16/197 |
| 2007/0011846 | A1 | 1/2007 | Braid et al. | |

* cited by examiner

*Primary Examiner*—Victor Batson
*Assistant Examiner*—Rowland D Do
(74) *Attorney, Agent, or Firm*—Brown & Michaels, PC

(57) ABSTRACT

A curl spring mount has a separate cover that can snap fit into the mount to cover and protect the curl springs. A portion of the cover disposed over the vertical space occupied by the curl springs is arranged outside a jamb channel so that the curl springs can occupy the full width of the channel. A shield portion of the cover extends transversely of the jamb channel above the curl springs to protect them from dirt.

20 Claims, 6 Drawing Sheets

FIG. 13
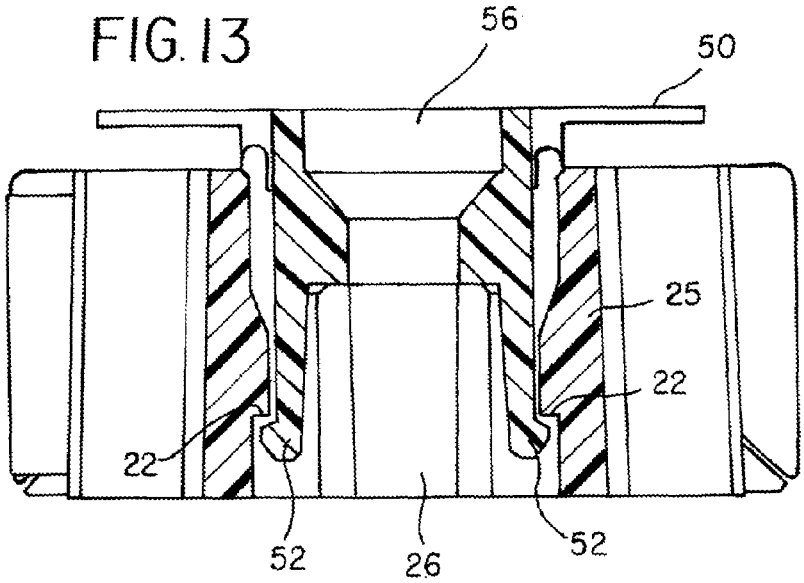
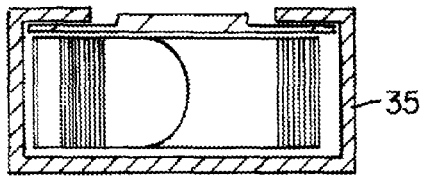
FIG. 14
(prior art)
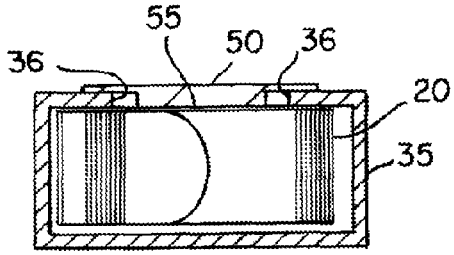
FIG. 15

CURL SPRING COVER

REFERENCE TO RELATED APPLICATIONS

This application claims benefit under 35 USC §119(e) of subject matter disclosed in Provisional Application No. 60/821,731, filed 8 Aug. 2006, entitled "Curl Spring Cover".

TECHNICAL FIELD

Counterbalances for vertically movable window sash

BACKGROUND

The invention of this application involves counterbalance curl springs that are mounted in a fixed position in a window to extend downward to counterbalance shoes that move vertically with a window sash. Mount supports and covers for such curl springs are suggested in U.S. Pat. Nos. 5,365,638; 6,584,644; 6,848,148; and in U.S. application Ser. No. 10/893,122. All of these suggestions use integral structures that not only support the curl springs in mounted positions within jamb channels of a window, but also cover them to help protect them from dirt, especially during building construction.

SUMMARY

This invention improves on the convenience and efficiency of curl spring mounts and covers. It separates the protective cover from the spring mount to achieve several advantages. These include the ability to separately mount or remount the curl springs and the cover that protects them. It also disposes the cover partially outside the jamb channel, rather than entirely within the jamb channel, so that the curl springs can be made wide enough to occupy all the space available within the jamb channel. Widening the curl springs, even slightly, increases their lifting force and enables the wider springs to counterbalance heavier sash than the narrower springs could accommodate.

DRAWINGS

FIGS. 1A-C show an isometric view of a curl spring mount accompanied by a sash shoe separate from a jamb channel in FIG. 1A, partially inserted into a jamb channel in FIG. 1B, and fully inserted into a jamb channel in FIG. 1C.

FIGS. 2A-C add a spring cover to corresponding views of the assembly of FIGS. 1A-C.

FIGS. 3-12 show, with differing isometric points of view, the partial insertion of a spring cover into an empty jamb channel in FIGS. 3 and 4, partial insertion of a spring cover into a jamb channel containing curl springs and a mount in FIGS. 5 and 6, movement of the cover toward a position covering the curl springs in FIGS. 7 and 8, snapping the cover downward to cover the curl springs in FIGS. 9 and 10, and the cover in a final assembled position in FIGS. 11 and 12.

FIG. 13 is a partially cross-sectional view of a snap fit interlock between the cover and the spring mount of the previous figures.

FIG. 14 is a cross-sectional view of a prior art spring cover occupying some of the space in a jamb channel, and FIG. 15 shows the inventive spring cover arranged partially outside a jamb channel to allow curl springs to be widened to the full width available within a jamb channel.

DETAILED DESCRIPTION

Figure 1A:
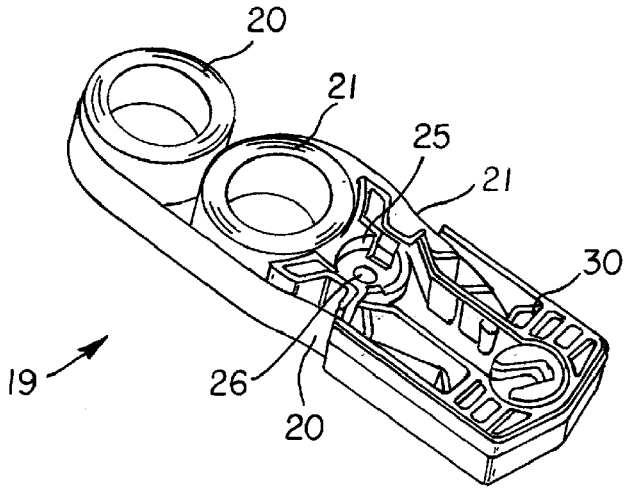

One preferred embodiment of the inventive spring mount and cover is shown in the drawings as mounting a pair of curl springs 20 and 21. Mount 25, which is secured in place within a window jamb channel, can also support a single curl spring or 3 or more curl springs, depending on several factors, including the weight of a sash to be counterbalanced. Also, curl spring counterbalance assemblies 19 such as shown in FIGS. 1-12, are used in pairs in a window and are arranged so that one counterbalance assembly balances each side of a vertically movable sash.

Counterbalance assembly 19, such as shown in FIG. 1A, comprising sash shoe 30 drawn snuggly against spring mount 25 by the counterbalance force of curl springs 20 and 21, forms an assembly that can be shipped to a window manufacturer who can install the assemblies in pairs in a window.

Figure 1B:
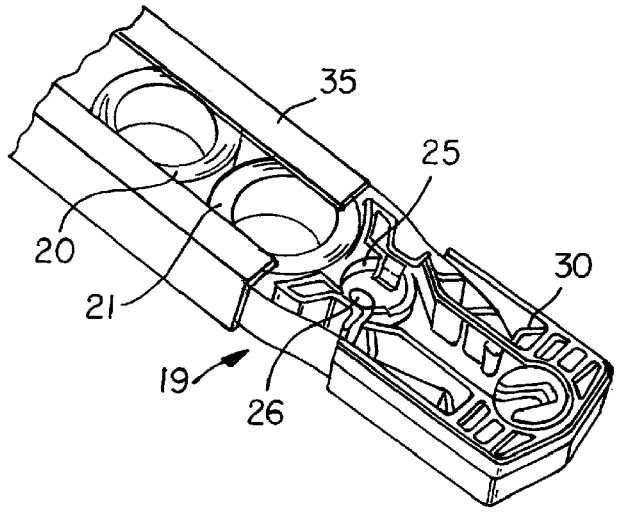
Figure 1C:
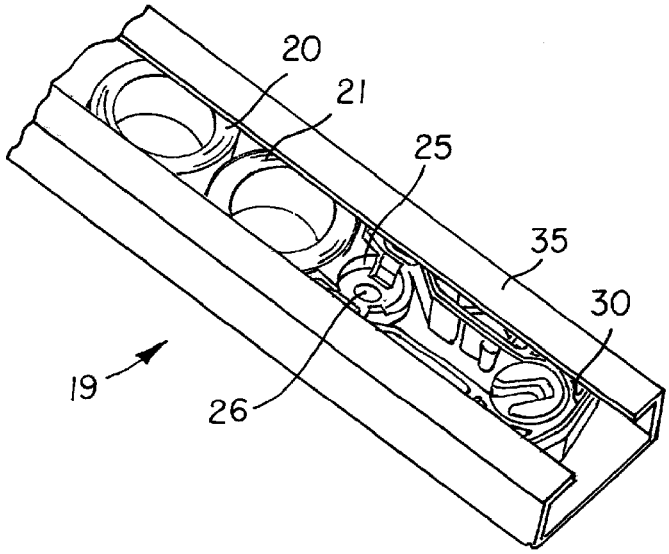
Figure 2A:
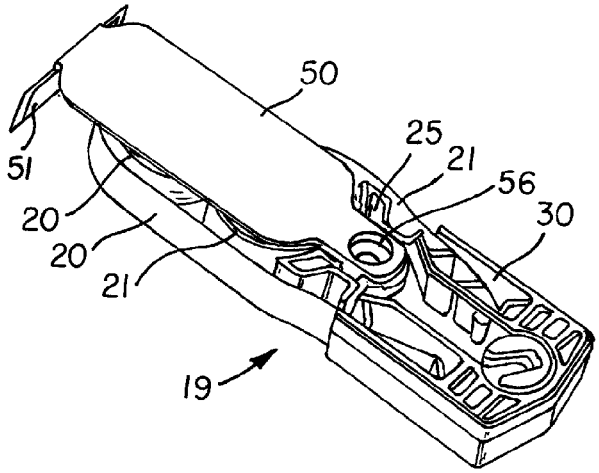
Figure 2B:
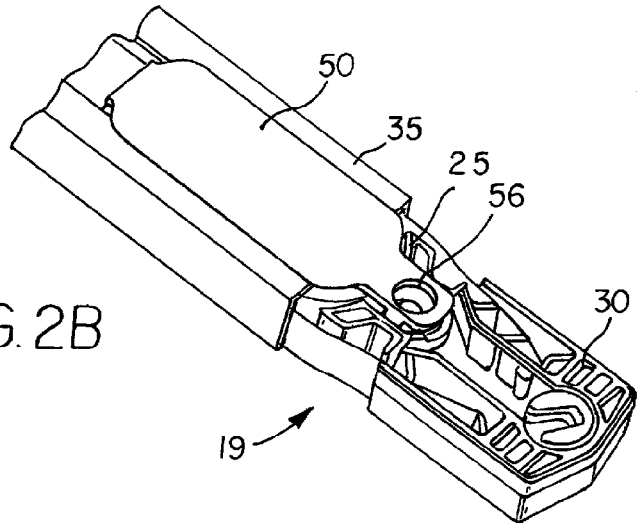
Figure 2C:
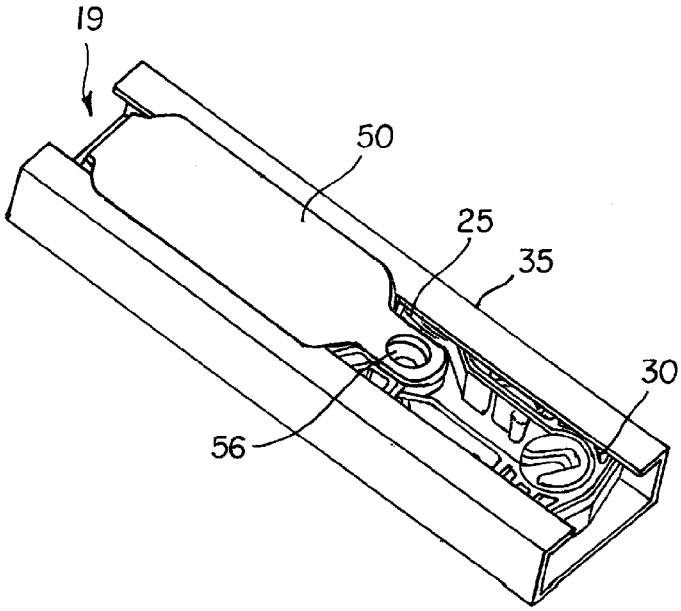
Figure 3:
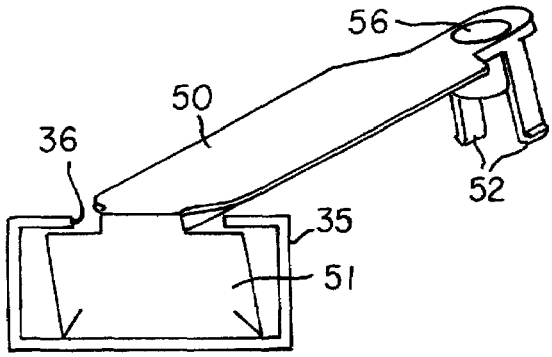
Figure 4:
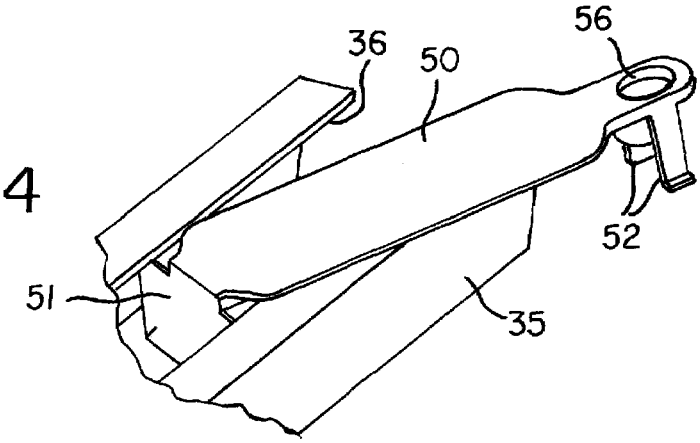

Counterbalance assembly 19 also preferably includes a cover 50, that is separable from the balance assembly and has a snap fit interlock with mount 25. A spring assembly without a cover 50 can be inserted into an open end of a jamb channel 35, as shown in FIGS. 1A-C, or can be inserted in a similar way with cover 50 in place, as shown in FIGS. 2A-C. Cover 50 can also be separately assembled to a counterbalance already installed in a jamb channel as shown in FIGS. 3-12. When an assembly reaches its mount destination, a screw is driven through a hole 56 in cover 50 and through a hole 26 in mount 25 to secure mount 25, cover 50, and springs 20 and 21 in an operating position.

Cover 50 includes an upper shield 51 that extends transversely across the space within jamb channel 35 to protect the curl spring assembly from dirt entering channel 35 and falling downward from above. Cover 50 is preferably made in suitable lengths so that it can snap fit to mount 25 and extend far enough to dispose shield 51 just above the uppermost one of the number of curl springs supported by mount 25. A snap connection 52 that gives cover 50 a snap fit with mount 25 also extends into channel 35. Otherwise, the rest of cover 50 is disposed outside of channel 35, as appears in FIGS. 2C, 11, 12, and 15.

FIGS. 3-12 show how cover 50 can be inserted into jamb channel 35 and maneuvered into a protective position over curl springs 20 and 21 after these are assembled into channel 35. The open-end assembly motion shown in FIGS. 2A-C preferably occurs when a window is originally manufactured. It can become necessary to replace curl springs 20 and 21, after they are installed in a window, and a jamb channel 35 often has a cut-out allowing a curl spring assembly to be removed and replaced through the cut-out slot when an open end of the jamb channel is not available. Replacing a previous assembly with a new assembly of curl springs, mount, and shoe inserted via a cut-out in jamb channel 35 cannot be done with cover 50 in place. The presence of cover 50 stiffens the longitudinal assembly of curl springs 21 and 22, mount 25, and shoe 30, so that these components cannot bend as necessary to slide out of and into a jamb channel cut-out.

Figure 5:
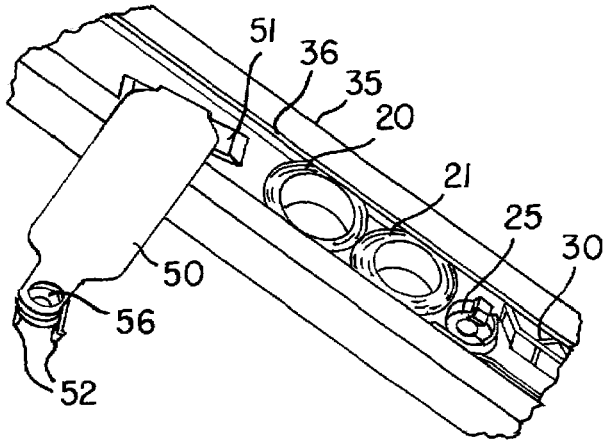
Figure 6:
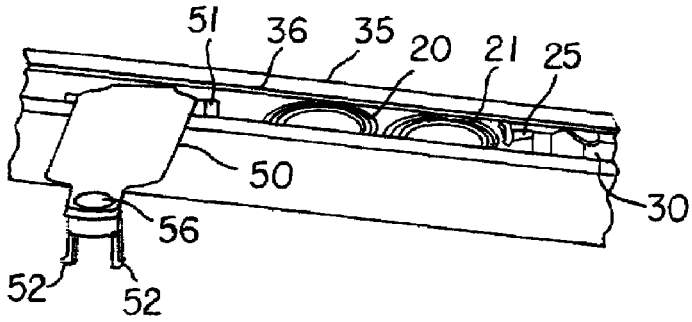
Figure 7:
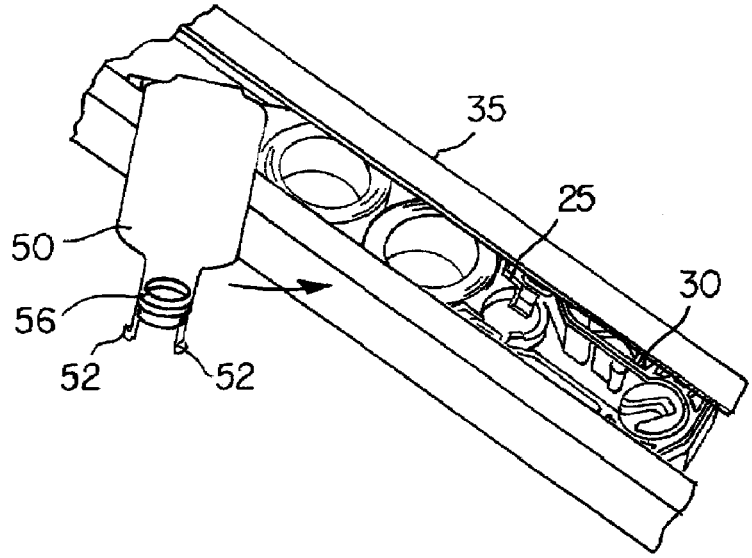
Figure 8:
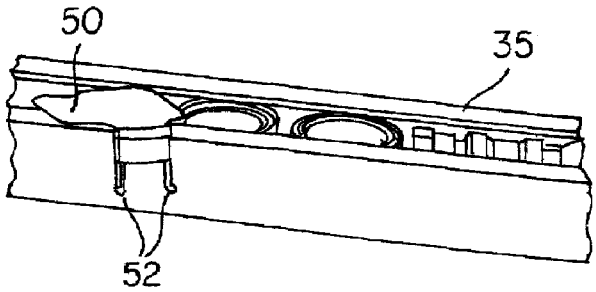
Figure 9:
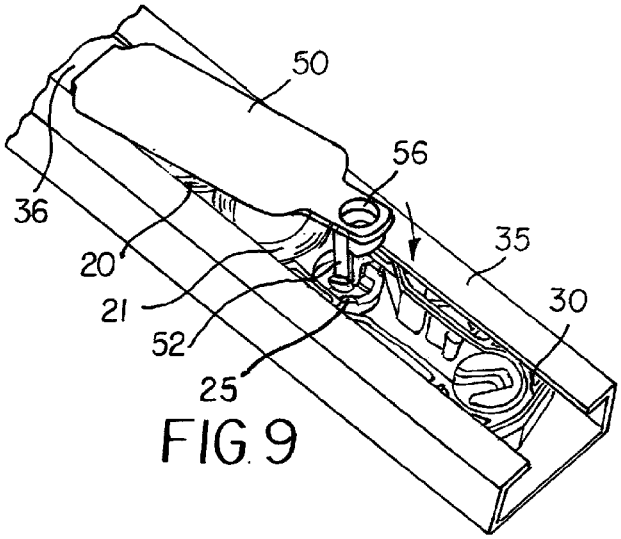
Figure 10:
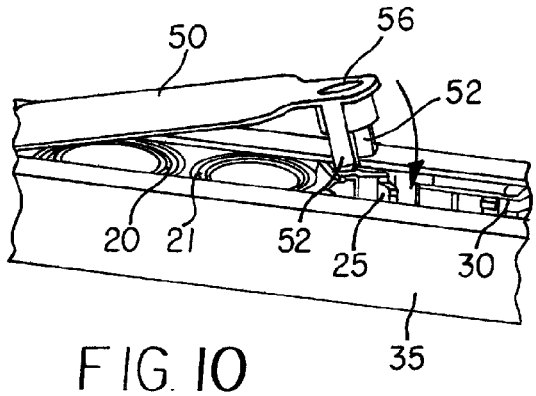

When this condition occurs, curl springs, with their mount and shoe, can be separately inserted through a cut-out into jamb channel 35 where they are then later protected by cover 50, in the process shown in FIGS. 3-12. Cover 50 is first angled relative to channel 35 so that shield 51 can fit through slot 36 in channel 35. This position is illustrated in FIGS. 5 and 6. Cover 50 is then turned toward alignment with curl springs 20 and jamb channel 35, as shown in FIGS. 7 and 8. This moves shield 51 toward a transverse position within jamb channel 35. As the cover movement continues to the position of FIGS. 9 and 10, cover 50 is aligned with jamb channel slot 36, and its snap lock detents 52 are positioned over mount 25 ready to be pushed downward into a snap interlock with mount 25. Shield 51, although not shown in FIGS. 9 and 10, is then disposed transversely of jamb channel 35 above the uppermost curl spring.

Figure 11:
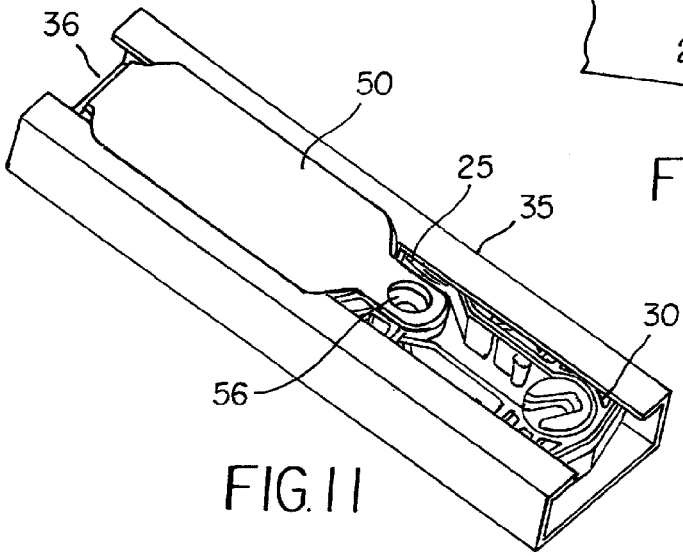
Figure 12:
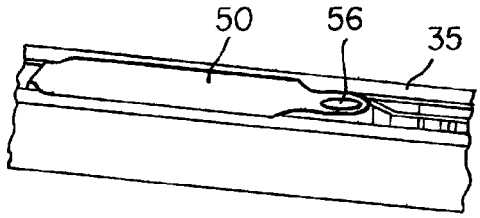

Finally, cover 50 is pushed downward to the position of FIGS. 11 and 12, which inserts snap lock projections 52 into mount 25 and positions cover 50 to protect the balance assembly. This also registers cover hole 56 with mount hole 26 so that a screw can pass through cover 50, mount 25, and into jamb channel 35 to support the curl spring assembly in a desired position. In this position, shield 51 extends transversely of channel 35 and protects the curl springs against dirt from above. At the same time, cover 50 conceals and protects the curl springs from dirt entering laterally into channel 35.

FIG. 13 shows how resilient snap locks 52 of cover 50 have a snap interlock with projections 22 in spring mount 25. Pushing cover 50 downward thrusts snap lock legs 52 into recesses in spring mount 25 as snap lock legs 52 bend inward. When cover is fully closed down over spring mount 25, the ends of legs 52 snap in under mount projections 22 and lock cover 50 into position. To disassemble the arrangement, cover 50 can be pried upward to unsnap locking elements 52.

Prior art spring covers, as illustrated in FIG. 14, have occupied some of the space available within channel 35 so as to limit the width of a curl spring arranged in channel 35 behind a spring cover. Cover 50, as shown in FIG. 15, does not extend into any of the space within channel 35 that is occupied by curl springs. Cover 50 has a ridge 55 arranged within slot 36 of jamb channel 35, and has its dirt protection shield 51 arranged above counterbalancing curl springs. Otherwise, cover 50 stays clear of the entire spring space within channel 35 so that the curl springs it protects can have the maximum width available within channel 35. The double-headed arrows in FIGS. 14 and 15 illustrate the available spring width, which is reduced in the prior art example of FIG. 14, and maximized with the inventive spring cover shown in FIG. 15. The counterbalance force of curl springs behind a cover within jamb channel 35 is proportional to the width of the springs so that wider springs have larger counterbalance forces. Keeping cover 50 outside of the region of jamb channel 35 that is occupied by curl springs thus optimizes the counterbalance force available from springs 20 and 21, which can then be as wide as channel 35 allows.

The invention allows many variations in configurations of spring mounts, shoes, and covers. These include different interconnections between these components, different locking operations for shoes 30, and different spring mounting configurations. Whatever alternatives are used, the separation of a cover 50 from a spring mount 25 facilitates several advantages. It allows the cover to be disposed outside the jamb channel and to be attachable to the spring mount after the spring mount and curl springs have been assembled into a jamb channel. The separate cover having a snap fit connection to the spring mount and being disposed outside the jamb channel not only facilitates window repairs and replacement of curl springs, spring mounts, and shoes, as may become necessary, but also maximizes the counterbalance force that can be obtained from curl springs whose width is not constricted by a cover occupying some of the curl spring space within a jamb channel.

I claim:

1. A curl spring assembly that includes at least one curl spring disposed within a jamb channel having a slot, the assembly comprising:

a spring mount fixed within the jamb channel to support a curl spring in an operative position within the jamb channel;

a protective cover separate from the spring mount;

the protective cover being releasably connected to and removable from the spring mount;

the protective cover having a slot cover portion and a channel cover portion;

the slot cover portion being formed as a strip wider than the slot in the jamb channel and arranged outside the jamb channel on a sash side of the jamb channel to cover the slot in the region of the spring mount and the curl spring;

the channel cover portion extending from the slot cover portion into the jamb channel in a region above the curl spring; and the channel cover portion extending transversely of the channel to block dirt from falling downward within the channel onto the spring assembly.

2. The curl spring assembly of claim 1 wherein the slot cover portion includes a ridge extending vertically in the region of the curl spring and disposed to extend into the jamb channel slot without extending into the jamb channel.

3. The curl spring assembly of claim 1 wherein the protective cover is configured to extend from the slot cover portion through the jamb channel slot to the channel cover portion.

4. The curl spring assembly of claim 1 wherein the channel cover portion is configured to deflect dirt from inside the jamb channel out through the jamb channel slot.

5. The curl spring assembly of claim 1 wherein neither the spring mount nor the protective cover occupies spring width space within the jamb channel.

6. The curl spring assembly of claim 3 wherein the protective cover configuration enables the channel cover portion to be inserted into the jamb channel through the jamb channel slot while the protective cover is oriented obliquely to the jamb channel and then allowing the protective cover to be rotated to align the slot cover portion with the jamb channel slot and to orient the channel cover portion transversely of the jamb channel.

7. A curl spring assembly comprising:

a spring mount secured within a jamb channel to support at least one curl spring within the jamb channel;

a protective cover separate from the spring mount and including a slot-closing strip that is disposed outside of the jamb channel on a sash side of a jamb channel, the strip being wider than a slot in the jamb channel;

the protective cover having a connector adapted to extend through the jamb channel slot and releasably connect to the curl spring mount; and the protective cover including a panel disposed within the jamb channel above the curl spring, the panel extending transversely of the jamb channel to protect the curl spring from dirt falling downward within the jamb channel.

8. The curl spring assembly of claim 7 wherein the slot-closing strip includes a ridge that extends along a length of the jamb channel slot without extending into the jamb channel.

9. The curl spring assembly of claim 7 wherein the protective cover is configured in the region between the slot-closing strip and the panel to allow the panel to the inserted into the jamb channel while the strip is oriented obliquely to the jamb channel whereupon the strip can be turned to alignment with the jamb channel, which disposes the panel transversely of the jamb channel.

10. The curl spring assembly of claim 7 wherein neither the spring mount nor the protective cover occupies spring width space within the jamb channel.

11. The curl spring assembly of claim 7 wherein the panel is configured to deflect dirt from inside the jamb channel out through the jamb channel slot.

12. A protective cover combined with a curl spring assembly, the combination comprising:

the protective cover has a connector extending through a slot in a jamb channel to releasably connect the cover to a mount for the curl spring assembly;

the protective cover having a slot closing strip extending upward on an outside of the jamb channel and on a sash side of the jamb channel, the strip being wider than the jamb channel slot;

an upper region of the slot closing strip extends through the jamb channel slot above the curl spring assembly; and the upper region of the slot closing strip supports a panel disposed within the jamb channel above the curl spring to block dirt from falling down the jamb channel onto the curl spring.

13. The combination of claim 12 wherein the slot closing strip has a ridge that extends into the jamb channel slot without extending into the jamb channel.

14. The combination of claim 12 wherein the upper region of the slot closing strip allows the channel closing panel to be inserted into the jamb channel through the slot while the protective cover is oriented obliquely to the jamb channel and is thereafter rotated into alignment with the jamb channel, which disposes the panel transversely of the jamb channel.

15. The combination of claim 12 wherein the panel is configured to direct dust out of the jamb channel and through the jamb channel slot.

16. The curl spring assembly of claim 12 wherein neither the spring mount nor the protective cover occupies spring width space within the jamb channel.

17. A method of assembling a protective cover and a curl spring assembly that includes a mount fixed within a slotted jamb channel to support at least one curl spring, the method comprising:

arranging the curl spring assembly within a jamb channel, inserting a channel blocking panel of the protective cover through the jamb channel slot and into the jamb channel above the curl spring while the protective cover is oriented obliquely to the jamb channel;

rotating the cover to dispose the panel transversely of the channel and to align the protective cover with the jamb channel slot while the protective cover is outside of the jamb channel on the sash side of the jamb channel; and pressing a connector of the cover through the jamb channel slot and into engagement with the curl spring mount so that the panel closes a jamb channel space above the curl spring assembly and the protective cover overlaps and closes the jamb channel slot in the region of the curl spring.

18. The method of claim 15 including configuring the protective cover to dispose the panel to be angled from a portion of the protective cover that overlaps and closes the jamb channel slot.

19. The method of claim 17 including allowing a ridge on the protective cover to extend into the jamb channel slot without extending into the jamb channel.

20. The method of claim 17 including forming the panel to deflect dirt from inside the jamb channel out through the jamb channel slot.

* * * * *